United States Patent [19]

Kohzuki et al.

[11] Patent Number: 4,788,470

[45] Date of Patent: Nov. 29, 1988

[54] DEFLECTION YOKE APPARATUS WITH COMPENSATION MAGNETIC FIELD GENERATING MEANS

[75] Inventors: Keiji Kohzuki, Yokohama; Tsuneo Yoshida, Tokyo, both of Japan

[73] Assignee: Denki Onkyo Company Limited, Tokyo, Japan

[21] Appl. No.: 894,542

[22] Filed: Aug. 8, 1986

[30] Foreign Application Priority Data

Aug. 9, 1985 [JP] Japan ..... 60-175191

[51] Int. Cl.[4] ..... H01J 29/72; H01F 3/00

[52] U.S. Cl. ..... 313/440; 335/213; 315/370

[58] Field of Search ..... 313/440; 335/210, 212, 335/213; 315/364, 368, 370, 391

[56] References Cited

U.S. PATENT DOCUMENTS

| | | | |
|---|---|---|---|
| 3,305,807 | 2/1967 | Ashley et al. | 335/210 |
| 4,088,930 | 5/1978 | Barten | 335/213 X |
| 4,267,541 | 5/1981 | Narikiyo . | |

*Primary Examiner*—David K. Moore
*Assistant Examiner*—K. Wieder
*Attorney, Agent, or Firm*—Armstrong, Nikaido, Marmelstein & Kubovcik

[57] ABSTRACT

The deflection yoke apparatus has horizontal deflection coils, vertical deflection coils and a deflection core, and the horizontal deflection coils are electrically insulated from the vertical deflection coils by a coil separator. The coil separator is provided with an expanded chamber for accommodating the bend part of the horizontal deflection coil, and the first and second auxiliary magnetic field generating means is provided on the wall of the expanded chamber. The compensating current of a vertical deflection cycle is supplied to this means to compensate misconvergence.

5 Claims, 4 Drawing Sheets

DEFLECTION YOKE APPARATUS WITH COMPENSATION MAGNETIC FIELD GENERATING MEANS

The present invention relates to a deflection yoke apparatus particularly for a color television cathode-ray tube, which is provided with an auxiliary magnetic field generating means for converging three electron beams onto a screen of a cathode-ray tube.

As known, three electron beams are emitted in an in-line arrangmenet in the color-cathode ray tube and deflected by the deflection yoke mounted on the neck of the cathode-ray tube to facilitate convergence of three electron beams. In other words, the field controller serves to cause the electron beams to be easily aligned on the screen by passing the magnetic flux, which is generated from the horizontal deflection coil of the deflection yoke and varies in the horizontal deflection cycle through the field controller.

Recently, however, the cathode-ray tubes are widely used for character display applications and demanded to reproduce higher precision and higher resolution pictures. To fill such demand, the horizontal scanning frequency is increased, for example, from 15.75 KHz to 64 KHz. If the horizontal scanning frequency is increased, the field controller provided in the neck of the cathode-ray tube adversely affects the path of the central electron beam and therefore it is difficult to obtain a satisfactory convergence of three electron beams in the full range of the screen.

Figure 1:
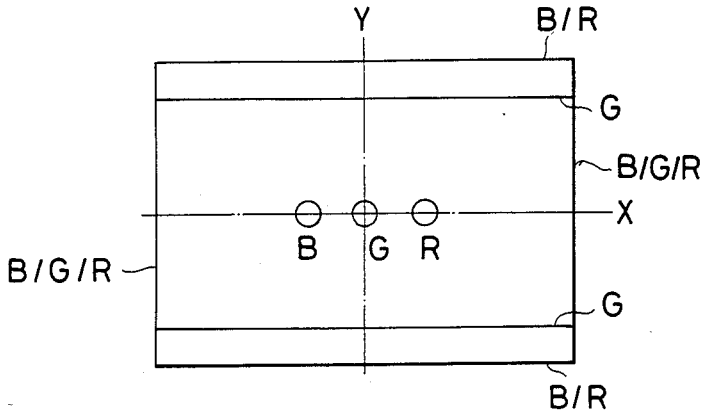
FIG. 1 PRIOR ART

For this reason, it is tended to use a cathode-ray tube which does not have the field controller in the neck for displaying with a high frequency horizontal deflection current. If an improved deflection yoke is employed for such cathode-ray tube as described above, three rasters made by three electron beams on the screen are aligned in the horizontal direction or the X-axis direction but they cannot be aligned in the vertical direction or the Y-axis direction and a misconvergence will remain as shown in FIG. 1. In other words, the raster G produced by the green beam at the center is narrower than the standard raster and the rasters R and B by red and blue beams are wider than the standard rasters.

The present invention is intended to dynamically shift the central beam and both side beams in the vertical deflection cycle by a cooperative function of two sets of auxiliary magnetic field generating means built in the deflection yoke even in case that the field controller is not provided in the neck of the cathode-ray tube and to obtain the convergence of three electron beams at all points on the screen.

The deflection yoke apparatus in accordance with the present invention provides a pair of horizontal deflection coils, a pair of vertical deflection coils, a coil separator which electrically insulates these pairs of coils, a deflection core and two sets of auxiliary magnetic field generating means. The coil separator is provided with the expanded chamber which accommodates the bend part of each horizontal deflection coil at the electron gun side of the cathode-ray tube. On the wall of the expanded chamber normal to the tube axis, the first auxiliary magnetic field generating means is provided in the vertical direction passing through the tube axis or a direction orthogonally interesecting the direction of in-line arrangement of electron beams, and the second auxiliary magnetic field generating means is provided in the horizontal direction passing through the tube axis or the direction of in-line arrangement of electron beams.

The first auxiliary magnetic field generating means comprises a pair of U-shaped cores and the first compensation coils which are wound around these cores with the legs of cores opposed across the neck of the cathode-ray tube. The second auxiliary magnetic field generating means comprises a pair of I-shaped or T-shaped cores and the second compensation coils which are wound around these cores with the ends of cores opposed across the neck. The first and second compensation coils are included in the compensation circuit and a vertical deflection current or a compensation current which varies in the vertical deflection cycle is supplied to these coils. The compensation circuit has a plurality of potentiometers and can relatively change the current flowing in the compensation coils by adjusting either these potentiometers, and the compensation coils comprise a pair of coils and can relatively change the current flowing through the coils by adjusting either of the potentiometers which are parallel-connected with the compensation coils.

If the current described above is supplied to the first and second compensation coils, the extreme ends of legs of U-shaped cores which are opposed across the cathode-ray tube neck are magnetized to provide the same polarities and the extreme ends of the I-shaped or T-shaped cores are magnetized a magnetic field formed by two poles in the horizontal direction and a magnetic field formed by six poles are produced simultaneously.

Figure 2:
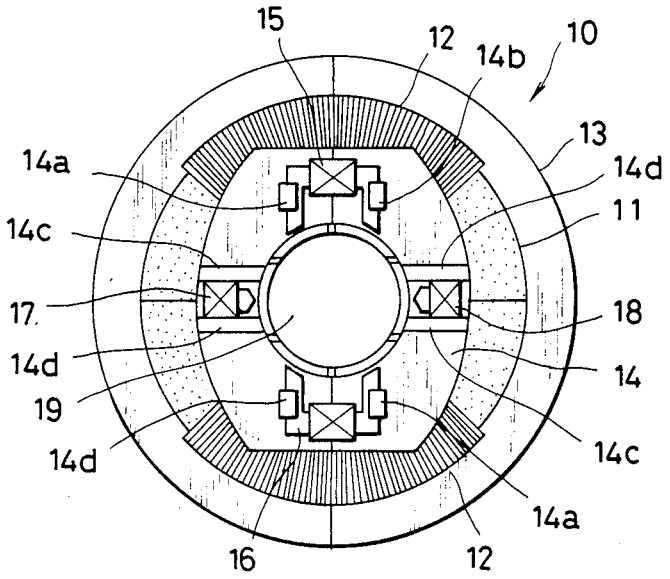
Figure 3:
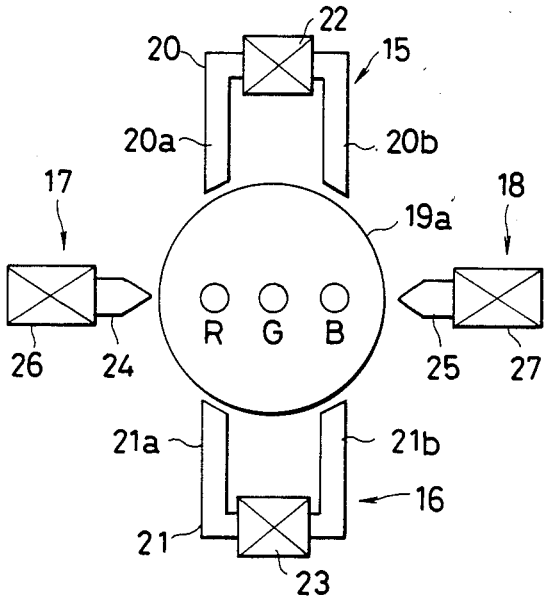
Figure 4:
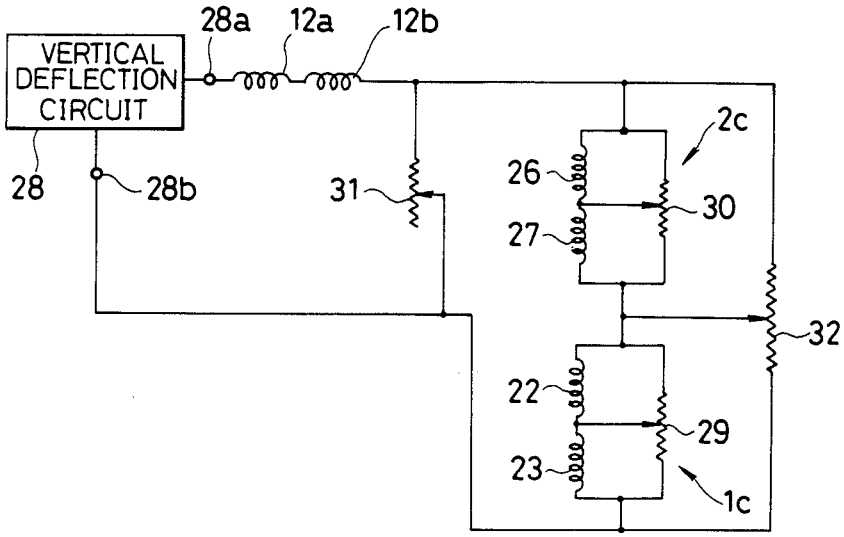
Figure 5:
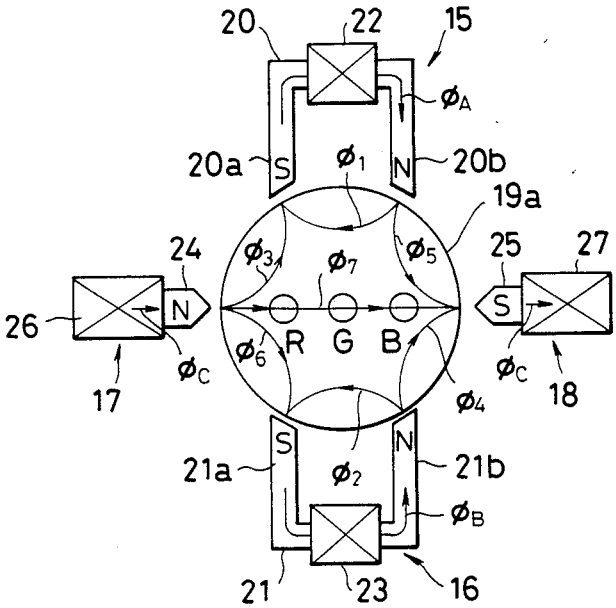
Figure 6:
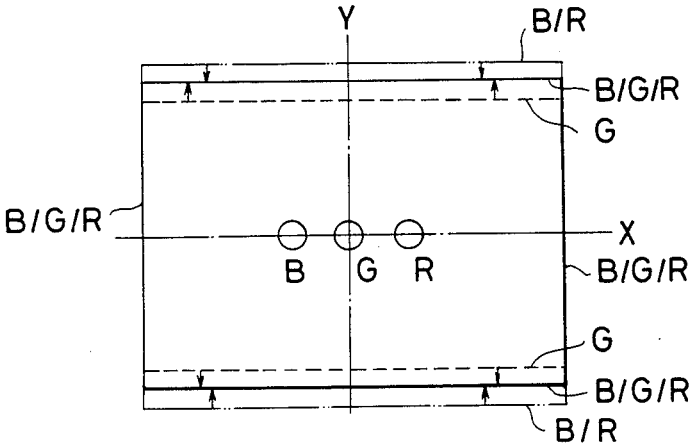
Figure 7:
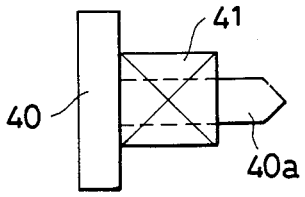
Figure 8:
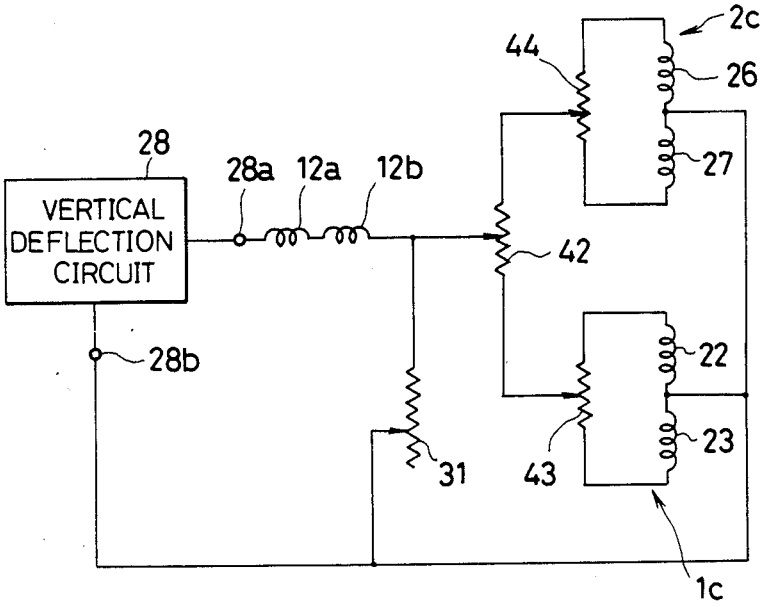

The following describes the accompanying drawings whereof:

FIG. 1 shows the rasters produced where no field controller is provided in the cathode-ray tube neck, FIG. 2 is the deflection yoke apparatus according to the present invention as viewed from the electron gun side of the cathode-ray tube, FIG. 3 shows the relative positions of the auxiliary magnetic field generating means and the cathode-ray tube neck, FIG. 4 is a connection diagram showing an example of the compensation circuit for use in the deflection yoke apparatus to the present invention, FIG. 5 is an explanatory diagram explaining the operation of the auxiliary magnetic field generating means, FIG. 6 is an explanatory diagram explaining a correction of rasters using the auxiliary magnetic field generating means, FIG. 7 is a diagram showing another embodiment of the auxiliary magnetic field generating means, and FIG. 8 is a connection diagram showing another embodiment of the compensation circuit for use in the deflection yoke apparatus according to the present invention.

Referring to FIG. 2, the deflection yoke apparatus 10 has the deflection core 11 which is cylindrically formed by assembling a pair of half cores around each of which the vertical deflection coil 12 is toroidally wound, the coil separator 13 is provided between a pair of saddle type horizontal deflection coils not shown and the core 11. The coil separator 13 is cylindrically formed by assembling a pair of half bobbins and has the expanded chamber 14 which is expanded in a direction orthogonally intersecting the tube axis to accommodate the bend part of each saddle type horizontal deflection coil not shown at the electron gun side of the cathode-ray tube. The first auxiliary magnetic field generating means 15, 16 and the second auxiliary magnetic field generating means 17, 18 are provided on the electron gun side wall of the expanded chamber 14 while being supported by the holding members 14*a*, 14*b*, 14*c* and 14*d*, respectively. In other words, the first auxiliary magnetic field generating means 15 and 16 are opposed in a direction at right angles to the direction of in-line arrangment of three electron beams with the opening 19 into which the neck of the cathode-ray tube interposed, while the second auxiliary magnetic field generating means 17 and 18 are installed opposing in the direction of in-line arrangement of three electron beams with the opening 19.

FIG. 3 shows the relative positions of the auxiliary magnetic field generating means 15 to 18 and the paths of electron beams passing through the neck of the cathode-ray tube. Circle 19*a* shows the external wall surface of the cathode-ray tube neck. Three electron beams, that is, red beam R, green beam G and blue beam B in the cathode-ray tube neck are shown. The first auxiliary magnetic field generating means 15, 16 comprise U-shaped cores 26, 21 and the first compensation coils 22, 23 wound around these cores. Legs 20*a*, 20*b*, 21*a*, 21*b* of the cores are opposed at the positions in a direction at right angles to the arrangement of electron beams with the cathode-ray tube neck interposed. In other words, the core leg 20*a* is opposed to the core leg 21*a* and the core leg 20*b* is opposed to the core leg 21*b*. On the other hand, the second auxiliary magnetic field generating means 17, 18 comprise the I-shaped cores 24, 25 on which the second compensation coils 26, 27 wound around the coil bobbins are mounted. The cores 24 and 25 are opposed each other at the positions in the direction of arrangement of three electron beams with the cathode-ray tube neck interposed. The extreme ends of opposing cores 24 and 25 are tapered.

FIG. 4 shows an example of the compensation circuit which supplies the compensation current to the first compensation coils 22, 23 and the second compensation coils 26, 27. A pair of vertical deflection coils 12*a*, 12*b* are connected in series and connected to the terminals 28*a*, 28*b* of the vertical deflection circuit 28 through the resistor 31 which adjusts the vertical coma green height. The resistor 31 is a variable resistor and the current flowing through the compensation circuits connected to both ends of the resistor 31 varies with the adjustment of the resistor. The compensation circuits have the first compensation circuit section 1C and the second compensation circuit section 2C which are connected in series. This series-connected circuit is parallel-connected to the first potentiometer 32 and its moving element is connected between the first and second compensation circuit sections 1C and 2C, thus making it possible to relatively adjust the compensation current flowing through the compensation circuit sections 1C and 2C. In other words, if the current flowing in one circuit 1C increases, the current flowing in the other circuit 2C can be reduced.

The first compensation circuit section 1C comprises the series-connected first compensation coils 22, 23 and the second potentiometer 29 parallel-connected to the first compensation coils 22, 23 and its moving element is connected between both compensation coils 22 and 23 to make it possible to relatively adjust the compensation current flowing in these coils. Similarly, the second compensation circuit section 2C comprises the series-connected second compensation coils, and the moving element of the potentiometer is connected between two compensation coils 26 and 27, thus making it possible to relatively adjust the current flowing in two coils 26 and 27.

Referring to FIGS. 5 and 6, the operation of the deflection yoke apparatus according to the present invention is described. The cathode-ray tube in the neck of which no field controller is provided is used. The horizontal deflection coils generate a pin cushion type horizontal deflection magnetic field and the vertical deflection coils generate a barrel type vertical deflection magnetic field. Owing to cooperative action of these components, though three electron beams are converged in the X-axis direction on the screen as shown in FIG. 6, the raster G which is produced by the green beam at the center of three beams in the Y-axis direction is narrower as shown with a dotted line than the standard raster shown with a solid line and the rasters R and B produced by the blue beam and the red beam at both sides of three beams are wider as shown with a one-dotted broken line than the standard rasters.

A part of the vertical deflection current is supplied to the compensation circuits shown in FIG. 4. The direction of magnetic flux shown in FIG. 5 indicates that three electron beams scan the upper part of the screen, that is, the part above the X axis in FIG. 6 but the spread of magnetic field is not shown to simplify the diagram. The magnetic fields $\phi_A$ and $\phi_B$ in the arrow-indicated directions are generated in the first compensation coils 22, 23 and the core legs 20*a* and 21*a* are magnetized as the S pole and the core legs 20*b* and 21*b* as the N pole. The magnetic field $\phi_C$ in the arrow-indicated direction is generated in the second compensation coils 26 and 27 and the extreme end of core 24 at the neck side is magnetized as the N pole and that of the core 25 as the S pole. Magnetic fields $\phi_1$ to $\phi_7$ in the arrow-indicated direction are produced by these magnetic poles in the cathode-ray tube neck. In other words, magnetic fields $\phi_1$ and $\phi_2$ are mainly produced by magnetic fields $\phi_A$ and $\phi_B$ and magnetic fields $\phi_3$ to $\phi_7$ mainly by the magnetic field $\phi_C$. The magnetic field $\phi_1$ shifts upwardly the green beam more than the red and blue beams and the magnetic field $\phi_7$ shifts downwardly the beams at both sides more than the green beam. Accordingly, the raster G made by the green beam is widened and the rasters B and R made by the blue and red beams are narrowed. If three electron beams are positioned on the X axis, the vertical deflection current is zero and the electron beams are not affected by the magnetic field $\phi_7$.

When three electron beams scan the lower part of the screen, the direction of the magnetic field shown in FIG. 5 will be reversed. In other words, the magnetic field $\phi_2$ affects the green beam more remarkably than other beams and the magnetic field $\phi_7$ affects the red and blue beams more remarkably, thus eliminating misconvergence.

The amounts of shift of green raster G and red and blue raster B/R in FIG. 6 can be relatively varied by shifting the moving element of the first potentiometer of the compensation circuits. The amount of shift of the raster G by the green beam can be relatively varied in the upper and lower parts of the screen by shifting the moving element of the second potentiometer 29. For example, if the amount of shift on the upper part of the screen is large, the amount of shift on the lower part will reduce. In addition, the amount of shift of the raster B/R can be relatively varied in the upper and lower parts of the screen by shifting the moving element of the third potentiometer 30.

FIG. 7 shows another embodiment of the second auxiliary magnetic field generating means in which the T-shaped core 40 is used instead of the I-shaped core and the compensation coil 41 is mounted on the core leg 40*a*. With this core, the magnetic reluctance of the space magnetic path can be reduced and the current for the coil 41 can be reduced accordingly.

FIG. 8 shows another embodiment of the compensation circuit. The moving element of the first potentiometer 42 is connected between the deflection coil 12*b* and the resistor 31, and both ends of the potentiometer 42 are connected to the moving elements of potentiometers 43 and 44. The first compensation coils 22 and 23 are series-connected across the second potentiometer 43 and the second compensation coils 26 and 27 are series-connected across the third potentiometer 44. The terminal 286 is connected between the first and second compensation coils 22 and 23 and between 26 and 27. This circuit features that the current flowing in the compensation coils largely varies by shifting the moving elements of potentiometers.

The first and second auxiliary magnetic field generating means can be mounted on the side wall of the screen of the expanded chamber of the coil separator or can be installed in a space between this wall and the deflection core. The vertical deflection coil can be a saddle type coil.

What is claimed is:

1. A deflection yoke apparatus for use on a cathode-ray tube in the neck of which three electron beams are aligned in an in-line alignment direction and emitted from an electron gun and a field controller made of a magnetic member is not provided, comprising:

(a) a pair of saddle type horizontal deflection coils which generate a deflection magnetic field for deflecting three electron beams in a horizontal dirction, said coils having a bend part made up by bending at its electron gun side, (b) a pair of vertical deflection coils which generate a deflection magnetic field for deflecting three electron beams in a vertical direction, (c) a coil separator which surrounds said horizontal deflection coils and electriclly insulates said horizontal deflection coils from said vetical deflection coils, said coil separator being made up by assembling a pair of bobbin halves made of a plastic material and provided with an expanded chamber, which is expanded in a direction at right angles to the axis of said cathode-ray tube, at said electron gun side to accommodate the bend part of said horizontal deflection coils, (d) A pair of first auxiliary magnetic field generating means which are provided on the wall of said expanded chamber to oppose each other in a vertical direction with the neck of said cathode-ray tube interposed, wherein said first auxiliary magnetic field generating means includes a pair of U-shaped cores having legs extending proximal to the neck of the tube and first compensation coils mounted on said U-shaped cores.

(e) A pair of second auxiliary magnetic field generating means which are provided on the wall of said expanded chamber to oppose each other in a horizontal direciton with the neck of said cathode-ray tube inteposed, wherein said second auxiliary magnetic field generating means includes a pair of I-shaped cores and second compensation coils mounted on said I-shaped cores, and (f) a first circuit means for supplying a compensation current from a compenstion current source to said first and second auxiliary magnetic field generating means, and (g) a second circuit means for interconnecting said first and second compensation coils such that opposing legs of said opposing pair of U-shaped cores are magnetized to have the same polarity and said I-shaped cores are magnetized to have opposite polarities such that legs of said U-shaped cores and said I-shaped cores alternate in polarity around the circumference of the neck of the tube, when the compensation current is supplied to said first compensation coils and said second compensation coils of said first and second auxiliary magnetic field generating means, and wherein three electron beams are converged on the screen of the cathode-ray tube by raising a deflection sensitivity of an electron beam located at the center of three electron beams in the neck of said cathode-ray tube and reducing a deflection sensitivity of electron beams located at right and left positions by a compensation magnetic field generated from said first and second auxiliary magnetic field generating means when a compensation current is supplied from said current source to said auxiliary magnetic field generating means.

2. A deflection yoke apparatus in accordance with claim 1, wherein the extreme ends of said cores are protruded with an acute angle.

3. A deflection yoke apparatus in accordance with claim 1, wherein said second auxiliary magnetic field generating means comprises a pair of T-shaped cores and coils mounted on the legs of said cores.

4. A deflection yoke apparatus in accordance with claim 3, wherein the extreme ends of the legs of cores are protruded with an acute angle.

5. A deflection yoke apparatus in accordance with claim 1, wherein said first circuit means comprises a first potentiometer which relatively varies the compensation current supplied to the first and second auxiliary magnetic field generating means, a compensation current flowing across said first compensation coils of the first auxiliary magnetic field generating means, and a third potentiometer which relatively varies the compensation current flowing across said second compensation coils of the second auxiliary magnetic field generating means.

* * * * *